US008240316B2

(12) United States Patent
Luo

(10) Patent No.: US 8,240,316 B2
(45) Date of Patent: Aug. 14, 2012

(54) VIBRATABLE AND REVERSIBLY ROTATABLE MASCARA APPLICATOR

(75) Inventor: Yun-Fa Luo, Taichung (TW)

(73) Assignees: Hideyoshi Takashima, Osaka (JP); Jung-Hui Huang, Taichung (TW)

( * ) Notice: Subject to any disclaimer, the term of this patent is extended or adjusted under 35 U.S.C. 154(b) by 169 days.

(21) Appl. No.: 12/732,025

(22) Filed: Mar. 25, 2010

(65) Prior Publication Data

US 2011/0088713 A1 Apr. 21, 2011

(30) Foreign Application Priority Data

Oct. 20, 2009 (TW) ..... 98219307 U

(51) Int. Cl.
*A45D 40/26* (2006.01)
*A46B 11/00* (2006.01)

(52) U.S. Cl. ..... 132/218; 401/129

(58) Field of Classification Search ..... 132/119.1, 132/218, 237, 238, 239, 313, 320; 401/118, 401/121, 127, 128, 122, 126, 129, 130, 195; 15/22.1, 23, 28; 310/81, 47
See application file for complete search history.

(56) References Cited

U.S. PATENT DOCUMENTS 4,829,156 A * 5/1989 Thompson ..... 219/225
6,502,584 B1 * 1/2003 Fordham ..... 132/218
6,565,276 B1 * 5/2003 Diaz ..... 401/129
6,661,138 B2 * 12/2003 Osawa et al. ..... 310/81
6,955,539 B2 * 10/2005 Shortt et al. ..... 433/118
8,021,065 B2 * 9/2011 Lou ..... 401/129
2002/0020425 A1 * 2/2002 Dorsa et al. ..... 132/218
2006/0032512 A1 * 2/2006 Kress et al. ..... 132/218
2006/0272668 A1 * 12/2006 Wyatt et al. ..... 132/218
2007/0127974 A1 * 6/2007 Chang et al. ..... 401/129
2007/0272269 A1 * 11/2007 Wyatt et al. ..... 132/320
2007/0286665 A1 * 12/2007 Bouix et al. ..... 401/1
2008/0138138 A1 * 6/2008 Gueret ..... 401/24
2008/0210254 A1 * 9/2008 Jeong et al. ..... 132/218
2008/0276955 A1 * 11/2008 Neuner et al. ..... 132/218
2009/0025746 A1 * 1/2009 Kim et al. ..... 132/217
2011/0097135 A1 * 4/2011 Luo ..... 401/126

* cited by examiner

*Primary Examiner* — Todd Manahan
*Assistant Examiner* — Niyati D Shah

(57) ABSTRACT

A mascara applicator includes a main body, a rod and a bottle. The main body defines a receiving space therein. The main body has a power source and a reversible DC motor. The power source electrically connects to the DC motor. The DC motor includes a rotor. At least one counterweight block is disposed on the rotor so that a center of mass of the rotor is offset from the axle. The rod has a first end attached to the axle in a rotational operative relationship and a second end attached with an applicator head. The bottle defines a liquid chamber and an opening. The opening communicates with the liquid chamber, and the rod extending into the liquid chamber through the opening. The rod is sleeved with a gasket, so that the gasket blocks the opening and seals the liquid chamber when the main body is affixed to the bottle.

10 Claims, 3 Drawing Sheets

VIBRATABLE AND REVERSIBLY ROTATABLE MASCARA APPLICATOR

BACKGROUND OF THE INVENTION

1. Field of the Invention

The present invention relates to a mascara applicator, and more particularly to a vibratable and reversibly rotatable mascara applicator.

2. Description of the Prior Art

Some of the conventional mascara applicators have a vibration motor, which has an axle attached with a counterweight block. As such, the counterweight block provides the axle with a centrifugal force and makes the axle to vibrate.

In addition, the conventional applicators have a rod extending into a bottle containing mascara liquid. Such mascara liquid sometimes coagulates between threads.

SUMMARY OF THE INVENTION

The main object of the present invention is to provide a vibratable and reversibly rotatable mascara applicator.

To achieve the above and other objects, a mascara applicator of the present invention includes a main body, a rod and a bottle. The main body defines a receiving space therein and has a power source and a reversible DC motor disposed in the receiving space. The power source electrically connects to the DC motor, which includes a rotor and an axle about which the rotor rotates. At least one counterweight block is disposed on the rotor so that a center of mass of the rotor is offset from the axle. The rod has a first end directly or indirectly attached to the axle in a rotational operative relationship and a second end attached with an applicator head. The bottle defines a liquid chamber and an opening disposed on one end of the bottle. The opening communicates with the liquid chamber, and the rod extends into the liquid chamber through the opening. The rod is sleeved with a gasket, so that the gasket blocks the opening and seals the liquid chamber when the main body is affixed to the bottle.

As such, the rod can be driven by the DC motor to vibrate as well as rotate, and the mascara liquid in the liquid chamber does not leak due to the gasket. Therefore, the users' needs can be satisfied.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
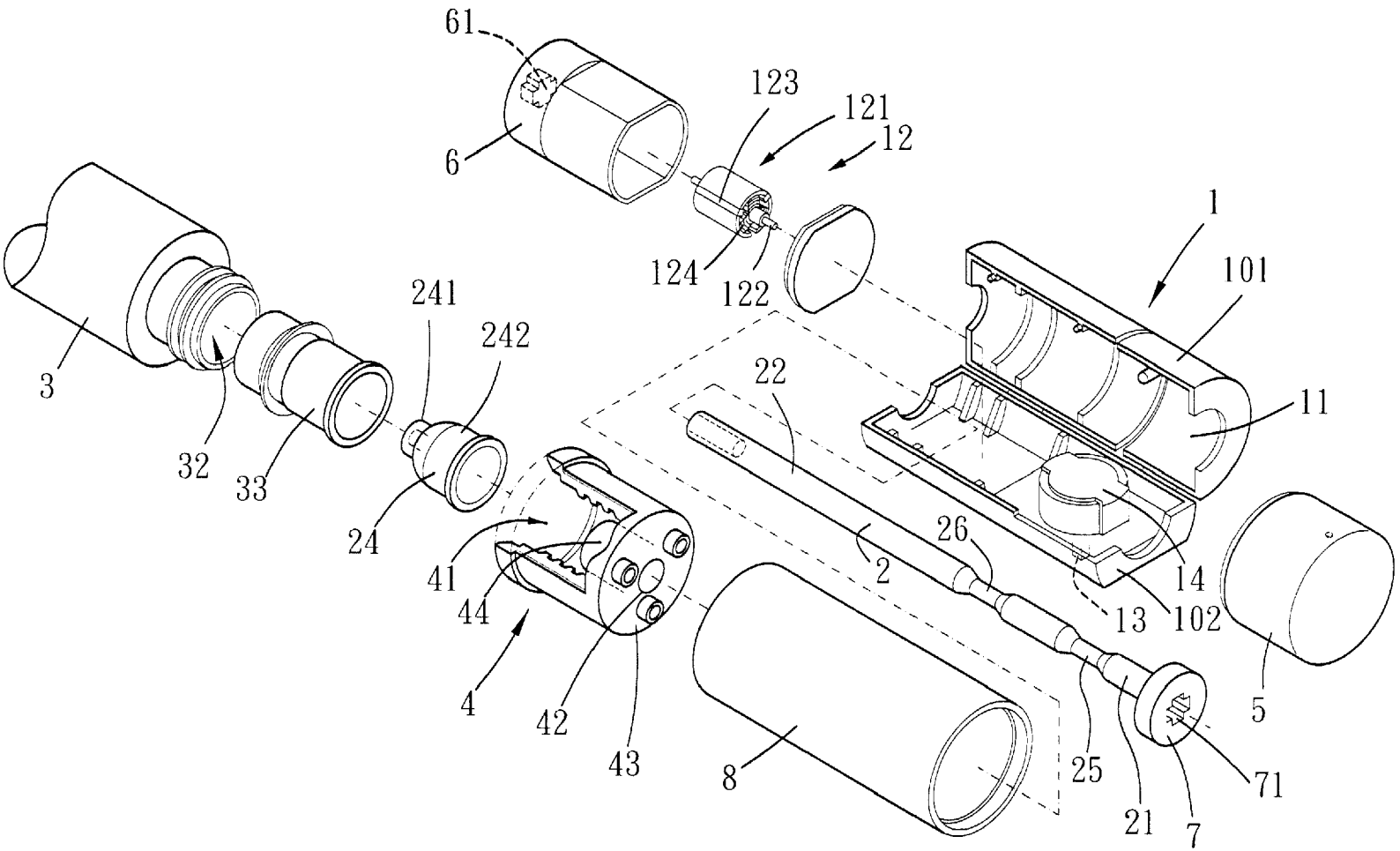
FIG. 1 is a breakdown drawing showing a mascara applicator of the present invention.
Figure 2:
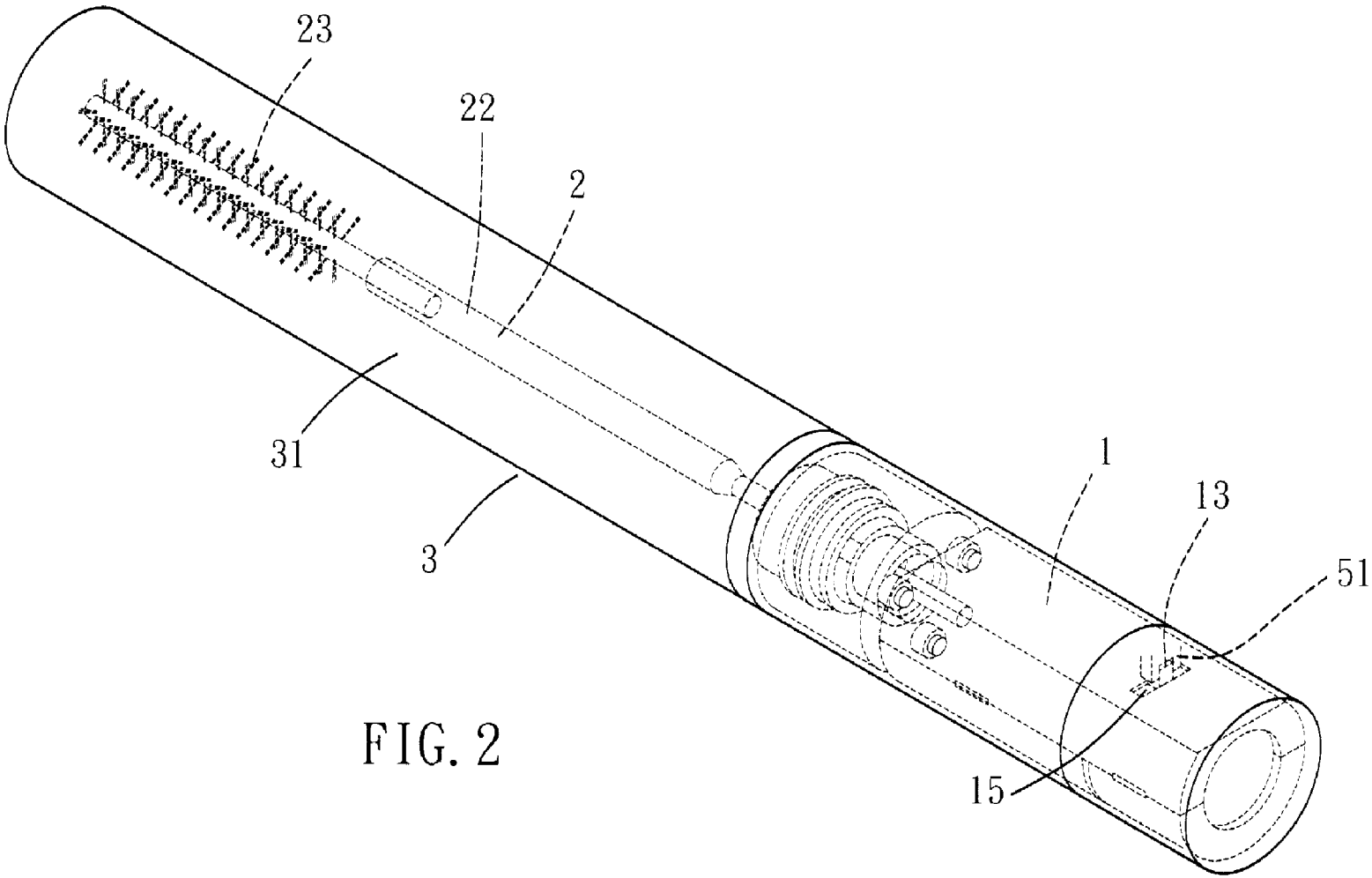
FIG. 2 is a perspective drawing showing a mascara applicator of the present invention.
Figure 3A:
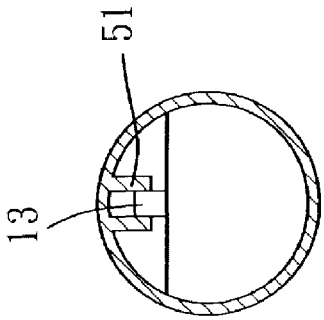
FIG. 3A is a profile showing a main body of the present invention.
Figure 3B:
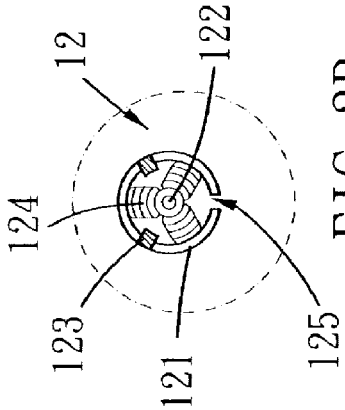
FIG. 3B is a profile showing a DC motor of the present invention.
Figure 3:
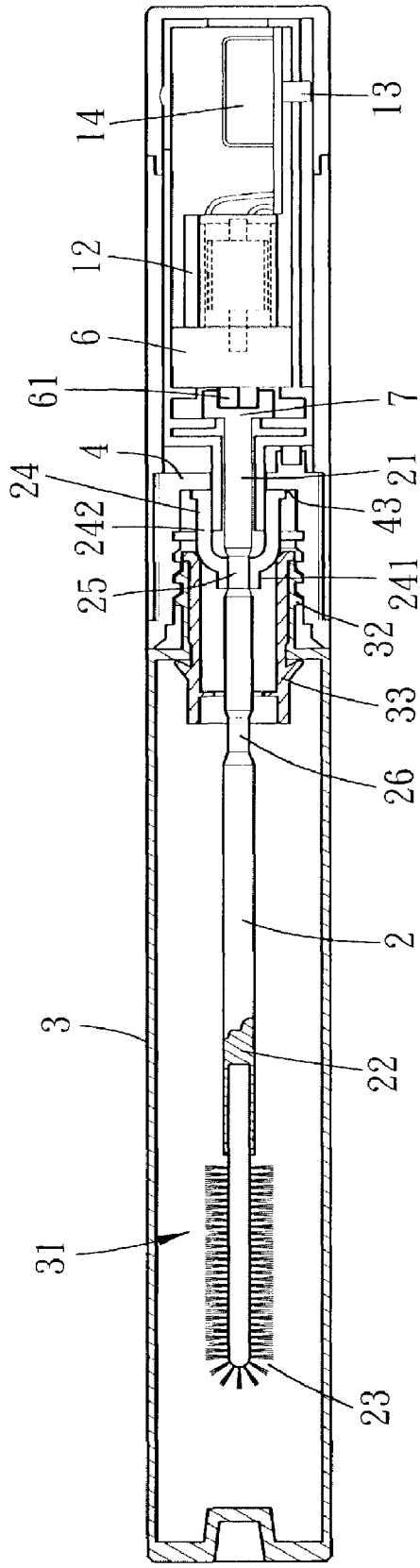
FIG. 3 is a profile drawing showing a mascara applicator of the present invention.

Please refer to FIG. 1 to FIG. 3. A vibratable and reversibly rotatable mascara applicator includes a main body 1, a rod 2, a bottle 3, a collar 4 and an end cap 5. The applicator may further include a hand grip 8 sleeving around the main body 1 and the collar 4.

The main body 1 defines a receiving space 11 therein and has a power source 14 and a reversible DC motor 12, in which the power source 14 electrically connects to the reversible DC motor 12. Preferably, a switch 13 is disposed between the power source 14 and the DC motor 12. The switch selectively electrically connects the power source 14 with the DC motor 12 and controls a direction of a current flow of the DC motor 12, so that the DC motor 12 selectively turns normally or reversely. In other words, the switch 13 is preferably provides three adjusting positions, which are a close position, a normal position and a reverse position, for the user to choose from. The DC motor 12 includes a rotor 121 and an axle 122, and may further include a y stator (field magnet), a brush and a rectifier. The rotor 121 can rotate about the axle 122, and it is provided with at least one counterweight block 123 so that the center of mass of the rotor 121 is offset from the axle 122. As shown in FIG. 3B, the rotor 121 of the present embodiment includes three winding sets 124, each of which makes an angle of 120 degrees to its adjacent one. A gap 125 is defined between every two of the winding sets 124, and the counterweight blocks 123 are disposed in two of the gaps 125. Furthermore, the main body 1 includes an upper part 101 and a lower part 102 pivoting to the upper part 101 so that the main body 1 can be opened. The receiving space 11 is, therefore, defined between the upper and lower parts 101 and 102. When the power source runs dead, the user can simply replace a new one after withdrawing the end cap 5 and opening the upper or lower part 101, 102. In addition, an annular rim may axially extend from a front end of the main body 1 toward the bottle 3, as shown in FIG. 3, or the annular rim may extend from the collar 4 instead, as shown in FIG. 1.

The rod 2 has a first end 21 and a second end 22, in which the first end 21 is directly or indirectly attached to the axle 122 in a rotational operative relationship, and the second end 22 is attached with an applicator head 23. A deceleration mechanism 6 is provided between the axle 122 and the rod 2 to adjust the revolution ratio of the rod 2 and the axle 122. A connector 7 is then provided between the deceleration mechanism 6 and the rod 2. In the present embodiment, the connector 7 and the rod 2 is formed in one-piece, yet the two elements may be separately formed. The deceleration mechanism 6 has a non-circular axle 61, and the connector 7 (or the first end 21 of the rod 2) is formed with a non-circular bore 71 to receive the non-circular axle 61 therein, so that the rod 2 and the non-circular axle 61 can be in a rotational operative relationship. The rod 2 is further sleeved with a gasket 24, so that the gasket 24 can block the opening 32 of the bottle 3 and seals the liquid chamber 31. More specifically, the rod 2 is formed with a waist portion 25 with a smaller diameter, and the gasket 24 has a joint section 241 and a skirt section 242 which has an open end facing the DC motor. The joint section 241 has a bore diameter corresponding to the waist portion 25, and the skirt section 242 has a bore diameter larger than that of the joint section 241. Thus the joint section 241 sleeves around the waist portion 25 and the gasket 24 is affixed on the rod 2. Moreover, the rod 2 is further formed with a neck portion 26 with a smaller diameter, and the neck portion 26 locates between the waist portion 25 and the second end 22 of the rod.

The bottle 3 defines a liquid chamber 31 and an opening 32 disposed on one end of the bottle 3. The opening 32 communicates with the liquid chamber 31. The rod 2 extends into the liquid chamber 31 through the opening 32. More specifically, the opening 32 is disposed with an annular wiper 33 through which the rod 2 extends into the liquid chamber 31, in which the wiper 33 and the gasket 24 are both made from soft resilient material. And preferably, the hardness of the gasket 24 is bigger than that of the wiper 33 so as to achieve better sealing effect. The wiper 33 has a bore diameter corresponding to the rod 2 to wipe off the mascara liquid adhere to the rod 2. When the neck portion 26 is passing through the opening 32, the air can flow into the liquid chamber 31 so that vacuum environment can be prevented in the liquid chamber 31, and the rod 2 can be easily drawn out of the bottle 3.

The collar 4 is disposed at a front end of the main body 1, and the collar is formed with inner threads. The bottle 3 is formed with outer threads around the opening 32 to mate with the inner threads of the collar 4. More specifically, the collar defines a larger-diametered bore 41 and a small-diametered bore 42 which communicate with each other. The collar 4 has an inner wall 43 away from the bottle 3, and the smaller-diametered bore 42 is formed on the inner wall 43. The collar 4 is further formed with an annular rim 44 surrounding the smaller-diametered bore 42 and extending from the inner wall 43 toward the bottle 3. The skirt section 242 of the gasket 24 sleeves around the annular rim 44 to further prohibit the mascara liquid from entering the receiving space 11 of the main body 1.

The end cap 5 rotatably sleeves around the main body 1, and the end cap 5 has an inner surface being formed with two protrusions 51. The main body 1 is formed with a transverse slot 15, and the switch 13 is slidably disposed in the slot 15 and is sandwiched between the protrusions 51, as shown in FIG. 3A. As such, the protrusions 51 drive the switch 13 to slide along the slot 15 as the end cap 5 is turned, thereby the switch 13 selectively electrically connects the power source 14 with the DC motor 12 and controls the direction of the current flow. The inner surface of the end cap 5 is formed with several round grooves, and the main body 1 has an outer surface being formed with a point selectively engaging with one of the round grooves. Preferably, as the point locates at one of the grooves, the switch 13 locates either at the close position, the normal position or the reverse position. Further, a connecting means is provided between the end cap 5 and the main body 1 to combine these two elements together.

In addition, an automatic power off (APO) IC is provided to connect the power source with the DC motor. The APO IC is used to detect whether the DC motor functions well or not. In some occasions, the DC motor may run idle when the gasket is tightly engaged with the wiper. Thus the APO IC can automatically power off the DC motor to prevent it from damage.

In summarization, the counterweight blocks are disposed on the rotor instead of the axle, so that the DC motor may have a smaller volume and become vibratable. The gasket is advantageous in prohibiting the mascara liquid from leakage. As a result, the mascara liquid will have little chance to coagulate between the threads or between the rotatable element and the non-rotatable element, which will further reduce the possibility of malfunctions of the mascara applicator.

What is claimed is:

1. A vibratable and reversibly rotatable mascara applicator, comprising:

a main body, defining a receiving space therein, the main body having a power source and a reversible DC motor disposed in the receiving space, the power source electrically connecting to the DC motor, the DC motor comprising a rotor and an axle about which the rotor rotates, wherein at lean one counterweight block is disposed on the rotor so that a center of mass of the rotor is offset from the axle;

a rod, having a first end directly or indirectly attached to the axle in a rotational operative relationship and a second end attached with an applicator head;

a bottle, defining a liquid chamber and an opening disposed on one end of the bottle, the opening communicating with the liquid chamber, the rod extending into the liquid chamber through the opening;

wherein the rod is sleeved with a gasket, so that the gasket blocks the opening and seals the liquid chamber when the main body is affixed to the bottle;

wherein the rod has a waist portion with a smaller diameter, the gasket has a joint section and a skirt section, extending from the joint section, the skirt section has an open end facing the DC motor, the joint section has a bore diameter corresponding to the waist portion, and the skirt section has a bore diameter larger than that of the joint section, the joint section sleeves around the waist portion;

wherein the applicator further comprising a collar disposed at a front end of the main body, the collar is formed with inner threads;

wherein the bottle is formed with outer threads around the opening to mate with the inner threads of the collar, and the opening is disposed with an annular wiper through which the rod extends into the livid chamber, the skirt section seals the wiper when the main body is affixed to the bottle;

wherein the collar defines a larger-diametered bore and a smaller-diametered bore which communicate with each other, the collar has an inner wall where the smaller-diametered bore is formed, the inner wall is located remote from the bottle, the collar is further formed with an annular rim surrounding the smaller-diametered bore and extending from the inner wall toward the bottle, the annular rim is received and sleeved by the skirt section of the gasket.

2. The applicator of claim 1, wherein a deceleration mechanism connects the axle with the rod.

3. The applicator of claim 2, wherein a connector connects the deceleration mechanism with the rod.

4. The applicator of claim 2, wherein the deceleration mechanism having a non-circular axle, the first end of the rod is formed with a non-circular bore to receive the non-circular axle, so that the rod and the non-circular axle are in a rotational operative relationship.

5. The applicator of claim 1, wherein a switch is disposed between the power source and the DC motor, the switch selectively electrically connects the power source with the DC motor and controls a direction of a current flow, so that the DC motor selectively turns normally or reversely.

6. The applicator of claim 5, further comprising an end cap rotatably sleeving around the main body, the end cap having an inner surface being formed with two protrusions, the main body being formed with a transverse slot, the switch being slidably disposed in the slot and being sandwiched between the protrusions, so that the protrusions are driving the switch to slide along the slot as the end cap is being turned, whereby the switch selectively electrically connects the power source with the DC motor and controls the direction of the current flow.

7. The applicator of claim 1, wherein the rotor comprises three winding sets, each of which makes an angle of 120 degrees to its adjacent winding set, a gap is defined between every two of the winding sets, at least one counterweight block is disposed in one or two of the gaps.

8. The applicator of claim 1, wherein the main body comprises an upper part and a lower part pivoting to the upper part so that the main body can be opened, the receiving space is defined between the upper and lower parts.

9. The applicator of claim 1, wherein the rod further has a neck portion with a smaller diameter, the neck portion is located between the waist portion and the second end of the rod.

10. The applicator of claim 1, wherein hardness of the gasket is bigger than hardness of the wiper.

* * * * *